US008833068B2

(12) United States Patent
Himoto et al.

(10) Patent No.: US 8,833,068 B2
(45) Date of Patent: Sep. 16, 2014

(54) WORK VEHICLE AND WORK VEHICLE CONTROL METHOD

(71) Applicant: Komatsu Ltd., Tokyo (JP)

(72) Inventors: Manabu Himoto, Kyotanabe (JP); Daisuke Tsumura, Hirakata (JP); Yoshimasa Ohbora, Kyoto (JP); Jin Yogita, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 14/003,690

(22) PCT Filed: Dec. 6, 2012

(86) PCT No.: PCT/JP2012/081614

§ 371 (c)(1),
(2), (4) Date: Sep. 6, 2013

(87) PCT Pub. No.: WO2013/179517

PCT Pub. Date: Dec. 5, 2013

(65) Prior Publication Data

US 2014/0060026 A1 Mar. 6, 2014

(30) Foreign Application Priority Data

May 28, 2012 (JP) ..... 2012-120726

(51) Int. Cl.

| | |
|---|---|
| ***F15B 11/08*** | (2006.01) |
| ***E02F 9/22*** | (2006.01) |
| ***F15B 20/00*** | (2006.01) |
| ***E02F 9/12*** | (2006.01) |
| ***E02F 9/26*** | (2006.01) |

(52) U.S. Cl.

CPC ..... *E02F 9/226* (2013.01); *F15B 2211/665* (2013.01); *E02F 9/2285* (2013.01); *E02F 9/2296* (2013.01); *F15B 2211/329* (2013.01); *F15B 2211/6316* (2013.01); *F15B 20/00* (2013.01); *F15B 2211/30525* (2013.01); *E02F 9/125* (2013.01); *F15B 2211/355* (2013.01); *E02F 9/265* (2013.01); *F15B 11/08* (2013.01); *F15B 2211/8643* (2013.01)

USPC ..... 60/459; 91/461

(58) Field of Classification Search

USPC ..... 60/459; 91/461

See application file for complete search history.

(56) References Cited

U.S. PATENT DOCUMENTS

| | | | | |
|---|---|---|---|---|
| 5,632,190 | A * | 5/1997 | Sunamura et al. | 91/461 |
| 8,098,128 | B2 * | 1/2012 | Arakawa | 340/5.2 |
| 2012/0000191 | A1 * | 1/2012 | Hagiwara et al. | 60/311 |

FOREIGN PATENT DOCUMENTS

| | | | |
|---|---|---|---|
| JP | 05-1436 | A | 1/1993 |
| JP | 06-33489 | A | 2/1994 |
| JP | 11-21079 | A | 1/1999 |
| JP | 2001-32332 | A | 2/2001 |

OTHER PUBLICATIONS

International Search Report for PCT/JP2012/081614, issued on Mar. 12, 2013.

* cited by examiner

*Primary Examiner* — Thomas E Lazo
(74) *Attorney, Agent, or Firm* — Global IP Counselors, LLP

(57) ABSTRACT

A lock valve switching section switches a lock valve from a locked state to a released state when a lock member is switched from a locked position to a release position. An erroneous operation monitoring section maintains the lock valve in the released state when the pilot pressure is equal to or more than a predetermined pressure when elapsed time, which is from a point in time where the lock member is switched from the locked position to the release position, is equal to or more than the predetermined time. The erroneous operation monitoring section switches the lock valve to the locked state when the pilot pressure is equal to or more than the predetermined pressure when the elapsed time is less than the predetermined time.

18 Claims, 5 Drawing Sheets

WORK VEHICLE AND WORK VEHICLE CONTROL METHOD

CROSS-REFERENCE TO RELATED APPLICATIONS

This application is a U.S. National application of International Application No. PCT/JP2012/081614. This U.S. National stage application claims priority under 35 U.S.C. §119(a) to Japanese Patent Application No. 2012-120726 filed in Japan on May 28, 2012, the entire contents of which are hereby incorporated herein by reference.

BACKGROUND

The present invention relates to a work vehicle and a control method of a work vehicle.

A work vehicle is provided with a hydraulic actuator and an operation member for operating the hydraulic actuator. An operator operates the hydraulic actuator using the operation member. In addition, a lock member for locking the operation of the hydraulic actuator by the operation member is provided in the work vehicle. For example, a lock lever is provided which is able to switch between a locked position and a release position in the work vehicle which is disclosed in Japanese Unexamined Patent Application Publication No. H11-21079. The operation of the hydraulic actuator is locked when the lock lever is operated to be in the locked position. Due to this, the hydraulic actuator is not activated even when the operator operates the operation lever. The lock of the hydraulic actuator is released when the lock lever is operated to be in the release position.

There is a possibility that the hydraulic actuator may carry out an unexpected action when the lock member is switched to the release position in a state where the operation member is operated in a position for carrying out activating of the hydraulic actuator (hereafter, referred to as an "activation position") in the work vehicle provided with a lock member as described above. In order to prevent such activating of the hydraulic actuator, it is effective if the operation member detects positioning at the activation position when the lock member is switched to the release position.

In Japanese Unexamined Patent Application Publication No. H11-21079, the setting pressure of a primary side pressure switch of the operation lever is set to a pressure which is lower than the setting pressure of a secondary side pressure switch. Accordingly, the primary side pressure switch is turned on before the secondary side pressure switch when the lock lever is switched to the release position in a state where the operation lever is set in the activation position. That is, the operation member is determined to be positioned in the the lock lever is switched to the release position in a state where the operation lever is set in the activation position. That is, the operation member is determined to be positioned in the activation position due to the primary side pressure switch being turned on before the secondary side pressure switch.

However, it is not easy to obtain sufficient determination accuracy in the determination using pressure switches such as described above. The object of the present invention is to provide a work vehicle and control method of a work vehicle where it is possible to accurately determine whether or not an operation member is operated to be in an activation position when a lock member has been switched to a release position.

A work vehicle according to a first aspect of the present invention is provided with a hydraulic actuator, an operation member, a pilot valve, an actuator control valve, a lock member, a lock valve, a lock valve switching section, an elapsed time detection section, an elapsed time determination section, a pilot pressure determination section, and an erroneous operation monitoring section. The operation member is a member for operating the hydraulic actuator. The pilot valve outputs pilot pressure according to operation of the operation member. The actuator control valve controls the hydraulic actuator according to a pilot pressure which is input. The lock member is able to be switched a locked position and a release position. The lock valve is switched a released state and a locked state. The lock valve permits the supply of pilot pressure to the actuator control valve in the released state. The lock valve blocks the supply of pilot pressure to the actuator control valve in the locked state. The lock valve switching section switches the lock valve from the locked state to the released state when the lock member is switched from the locked position to the release position. The elapsed time detection section detects elapsed time from a point in time where the lock member is switched from the locked position to the release position. The elapsed time determination section determines whether or not the elapsed time is equal to or more than a predetermined time. The pilot pressure determination section determines whether or not the pilot pressure is equal to or more than a predetermined pressure. The erroneous operation monitoring section maintains the lock valve in the released state in a case where the pilot pressure is equal to or more than the predetermined pressure when the elapsed time is equal to or more than the predetermined time. The erroneous operation monitoring section switches the lock valve to the locked state in a case where the pilot pressure is equal to or more than the predetermined pressure when the elapsed time is less than the predetermined time.

A work vehicle according to a second aspect of the present invention is the work vehicle according to the first aspect where the predetermined time is a time until the pilot pressure rises to the predetermined pressure when the lock member is switched from the locked position to the release position in a state where the operation member is set in a position for activating the hydraulic actuator.

A work vehicle according to a third aspect of the present invention is the work vehicle according to the first aspect where the predetermined time is equal to or more than 0.2 seconds and equal to or less than 2 seconds.

A work vehicle according to a fourth aspect of the present invention is the work vehicle according to the first aspect where a hydraulic pump which supplies hydraulic fluid to the pilot valve is further provided. The lock valve is disposed in a fluid passage which connects the hydraulic pump and the pilot valve.

A work vehicle according to a fifth aspect of the present invention is the work vehicle according to the first aspect which is further provided with a controller, a pilot pressure detection section, the lock valve switching section, a first signal line, a second signal line, a third signal line, a relay, and a fourth signal line. The controller includes the elapsed time detection section, the elapsed time determination section, and the erroneous operation monitoring section. The pilot pressure detection section detects the pilot pressure. The lock valve switching section is linked to the activating of the lock member. The first signal line transmits a signal from the lock valve switching section to the lock valve. The second signal line transmits a signal from the lock valve switching section to the controller. The third signal line transmits a signal from the pilot pressure detection section to the controller. The relay is disposed in the first signal line. The fourth signal line transmits a signal from the controller to the relay.

A work vehicle according to a sixth aspect of the present invention is the work vehicle according to the first aspect where the pilot pressure is a first pilot pressure and the pilot valve outputs a plurality of pilot pressures which includes the first pilot pressure and a second pilot pressure which is output from a fluid passage which is different to the first pilot pressure. The erroneous operation monitoring section switches the lock valve to the locked state in a case where at least one of the pilot pressures from among the plurality of pilot pressures is equal to or more than the predetermined pressure when the elapsed time is less than the predetermined time.

A work vehicle according to a seventh aspect of the present invention is the work vehicle according to the first aspect where the erroneous operation monitoring section prohibits switching of the lock valve by the lock valve switching section as long as the lock member is not returned from the release position to the locked position when the elapsed time determination section determines that the elapsed time is less than the predetermined time.

A work vehicle according to an eighth aspect of the present invention is the work vehicle according to the first aspect which is further provided with a notification section. The notification section outputs notification with regard to the operator when the erroneous operation monitoring section switches the lock valve in the locked state.

A work vehicle according to a ninth aspect of the present invention is the work vehicle according to the first aspect which is further provided with a temperature detection section which detects a temperature of the hydraulic fluid. The elapsed time determination section increases the predetermined time as the temperature of the hydraulic fluid falls.

A work vehicle according to a tenth aspect of the present invention is the work vehicle according to any one of the first to the ninth aspects where the work vehicle is a hydraulic shovel which has a revolving body. The hydraulic actuator may be any one of a revolving motor which carries out revolution of the revolving body, a hydraulic motor for movement, a boom cylinder, an arm cylinder, or a bucket cylinder.

A control method according to an eleventh aspect of the present invention is a control method of a work vehicle. The work vehicle is provided with a hydraulic actuator, an operation member, a pilot valve, an actuator control valve, a lock member, and a lock valve. The operation member is a member for operating the hydraulic actuator. The pilot valve outputs pilot pressure according to operation of the operation member. The actuator control valve controls the hydraulic actuator according to a pilot pressure which is input. The lock member is able to be switched a locked position and a release position. The lock valve is switched a released state and a locked state. The lock valve permits the supply of pilot pressure to the actuator control valve in the released state. The lock valve blocks the supply of pilot pressure to the actuator control valve in the locked state. The control method is provided with the steps described below. The first step is switching the lock valve from the locked state to the released state when the lock member is switched from the locked position to the release position. The second step is detecting the elapsed time from a point in time when the lock member is switched from the locked position to the release position until the pilot pressure rises to the predetermined pressure. The third step is determining whether or not the elapsed time is equal to or more than a predetermined time. The fourth step is maintaining the lock valve in the released state when the elapsed time is equal to or more than the predetermined time. The fifth step is switching the lock valve to the locked state when the elapsed time is less than the predetermined time.

In a control method according to a twelfth aspect of the present invention, the lock valve is switched from the locked state, which prohibits activating of the hydraulic actuator, to the released state, which permits activating of the hydraulic actuator, when the lock member is switched from the locked position to the release position. Then, the lock valve is switched to the locked state in a case where the pilot pressure according to an operation of the operation member for operating the hydraulic actuator rises to a predetermined pressure within a predetermined time from a point in time when the lock member is switched from the locked position to the release position.

In the work vehicle according to the first aspect of the present invention, the erroneous operation monitoring section switches the lock valve from the locked state to the released state when the lock member is switched from the locked position to the release position. However, the erroneous operation monitoring section switches the lock valve to the locked state in a case where the pilot pressure is equal to or more than the predetermined pressure when the elapsed time is less than the predetermined time. The rapid rising of the pilot pressure in this manner has the meaning of switching the lock member to the release position in a state where the operation member is set in the activation position. Due to this, it is possible to accurately determine whether or not the operation member is set in the activation position when the lock member is switched to the release position. In addition, the erroneous operation monitoring section maintains the lock valve in the released state in a case where the pilot pressure is equal to or more than the predetermined pressure when the elapsed time is equal to or more than the predetermined time. The slow rising of the pilot pressure in this manner has the meaning of switching the lock member to the release position in a state where the operation member is not set in the activation position. Due to this, it is possible to accurately determine that the operation member is not set in the activation position when the lock member is switched to the release position.

In the work vehicle according to the second aspect of the present invention, it is possible to find and set the predetermined time using either experiments in advance or simulation.

In the work vehicle according to the third aspect of the present invention, it is possible to accurately determine whether or not the operation member is operated in the activation position when the lock member is switched to the release position.

In the work vehicle according to the fourth aspect of the present invention, it is possible to block the pilot pressure which is output through a plurality of fluid passages using one lock valve even in a case where the lock valve is connected to the plurality of pilot fluid passages in the pilot valve.

In the work vehicle according to the fifth aspect of the present invention, the lock valve is switched between the released state and the locked state according to activating of the lock member using the signal which is transmitted through the first signal line. It is possible for the controller to detect the lock member being positioned in either of the locked position or the release position using the signal which is transmitted through the second signal line. It is possible for the controller to detect the pilot pressure using the signal transmitted through the third signal line. It is possible for the controller to switch the lock valve to the locked state regardless of the activation of the lock member by sending a relay signal through the fourth signal line.

In the work vehicle according to the sixth aspect of the present invention, it is possible to more reliably suppress the unexpected activation of the hydraulic actuator when the lock member is switched to the release position.

In the work vehicle according to the seventh aspect of the present invention, it is possible to reliably suppress the unexpected activation of the hydraulic actuator.

In the work vehicle according to the eighth aspect of the present invention, it is possible for the operator to recognize erroneous operating of the operation member when the lock member is switched to the release position using notification from the notification section.

In the work vehicle according to the ninth aspect of the present invention, it is possible to more accurately determine whether or not the operation member is set in the activation position when the lock member is switched to the release position.

In the work vehicle according to the tenth aspect of the present invention, it is possible to perform the determination described above using the pilot pressure of any of the revolving motor, the hydraulic motor for movement, the boom cylinder, the arm cylinder, or the bucket cylinder.

In the control method of a work vehicle according to the eleventh aspect of the present invention, the lock valve is switched to the released state from the locked state when the lock member is switched to the release position from the locked position. However, the lock valve is switched to the locked state when the elapsed time is less than the predetermined time. The elapsed time being less than the predetermined time has the meaning of the pilot pressure rapidly rising since the lock member is switched to the released position. Due to this, it is possible to accurately determine whether or not the operation member is set in the activation position when the lock member is switched to the release position. In addition, the lock valve is maintained in the released state when the elapsed time is equal to or more than the predetermined time. The elapsed time being equal to or more than the predetermined time has the meaning of the pilot pressure slowly rising since the lock member is switched to the released position. Due to this, it is possible to accurately determine that the operation member is not set in the activation position when the lock member is switched to the release position.

In the control method of a work vehicle according to the twelfth aspect of the present invention, the lock valve is switched from the locked state to the released state when the lock member is switched from the locked position to the release position. However, the lock valve is switched to the locked state in a case where the pilot pressure rises to the predetermined pressure within the predetermined time after the lock member is switched from the locked position to the release position. That is, the lock valve is switched to the locked state in a case where the pilot pressure rapidly rises since the lock member is switched to the released position. Accordingly, it is possible to accurately determine whether or not the operation member is operated to be in the activation position when the lock member is switched to the release position.

DESCRIPTION OF EMBODIMENTS

Figure 1:
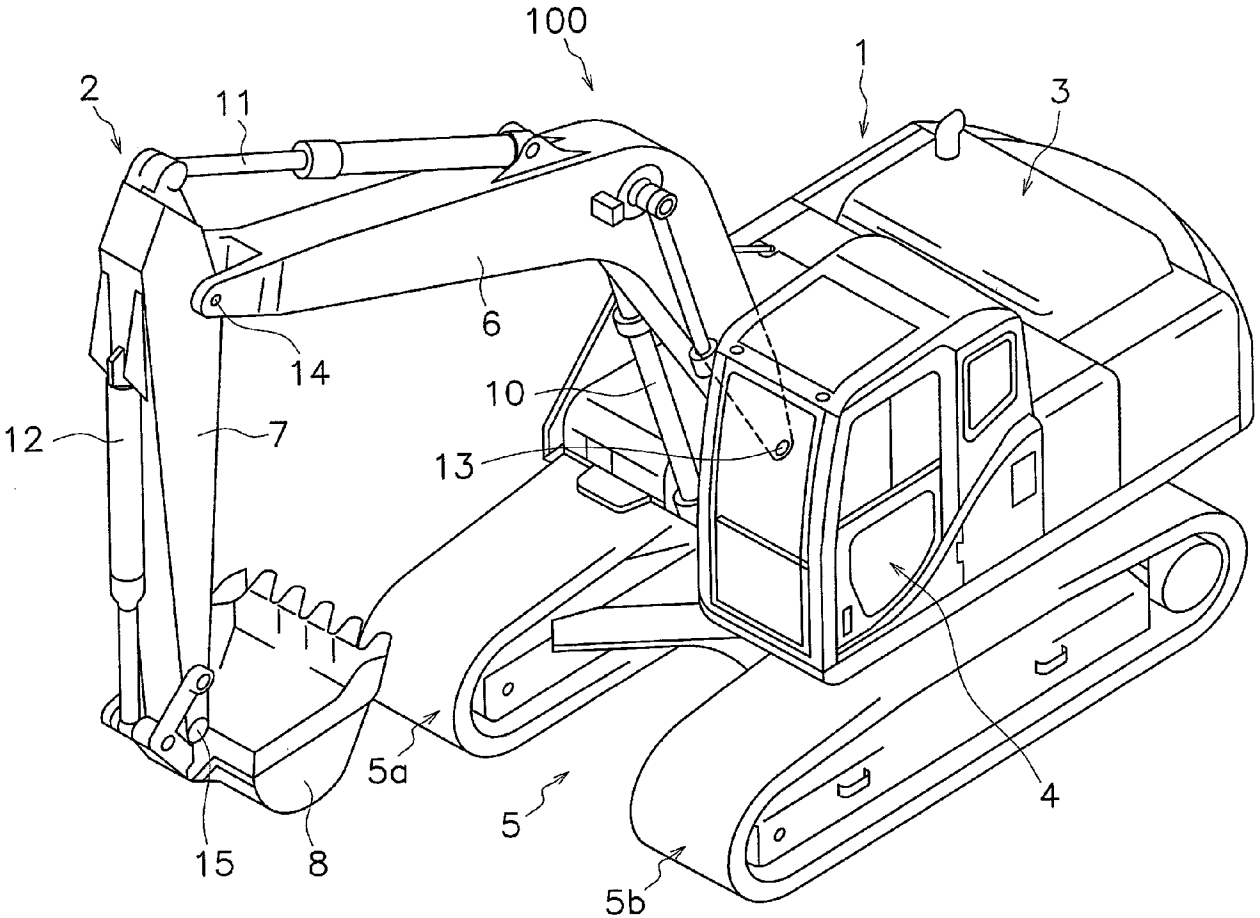
FIG. 1 is a perspective view of a work vehicle according to a embodiment of the present invention.

Below, a work vehicle according to an embodiment of the present invention will be described with reference to the drawings. FIG. 1 is a perspective view of a work vehicle 100. The work vehicle 100 is a hydraulic shovel. The work vehicle 100 has vehicle body 1 and a work machine 2. The vehicle body 1 has a revolving body 3, a cab 4, and a movement device 5. The cab 4 is mounted on the front portion of the revolving body 3. An operation device 25 which will be described below is disposed in the cab 4 (refer to FIG. 2). The movement device 5 has crawler tracks 5*a* and 5*b*, and the work vehicle 100 moves due to rotation of the crawler tracks 5*a* and 5*b*.

The work machine 2 is attached to the front portion of the vehicle body 1 and has a boom 6, and arm 7, a bucket 8, a boom cylinder 10, an arm cylinder 11, and a bucket cylinder 12. A base end section of the boom 6 is attached to the front portion of the vehicle body 1 via a boom pin 13 so as to be able to swing. A base end section of the arm 7 is attached to a tip end section of the boom 6 via an arm pin 14 so as to be able to swing. The bucket 8 is attached in a tip end section of the arm 7 via a bucket pin 15 so as to be able to swing. The boom cylinder 10, the arm cylinder 11, and the bucket cylinder 12 are driven using the hydraulic fluid which is discharged from a hydraulic pump 22 which will be described later.

Figure 2:
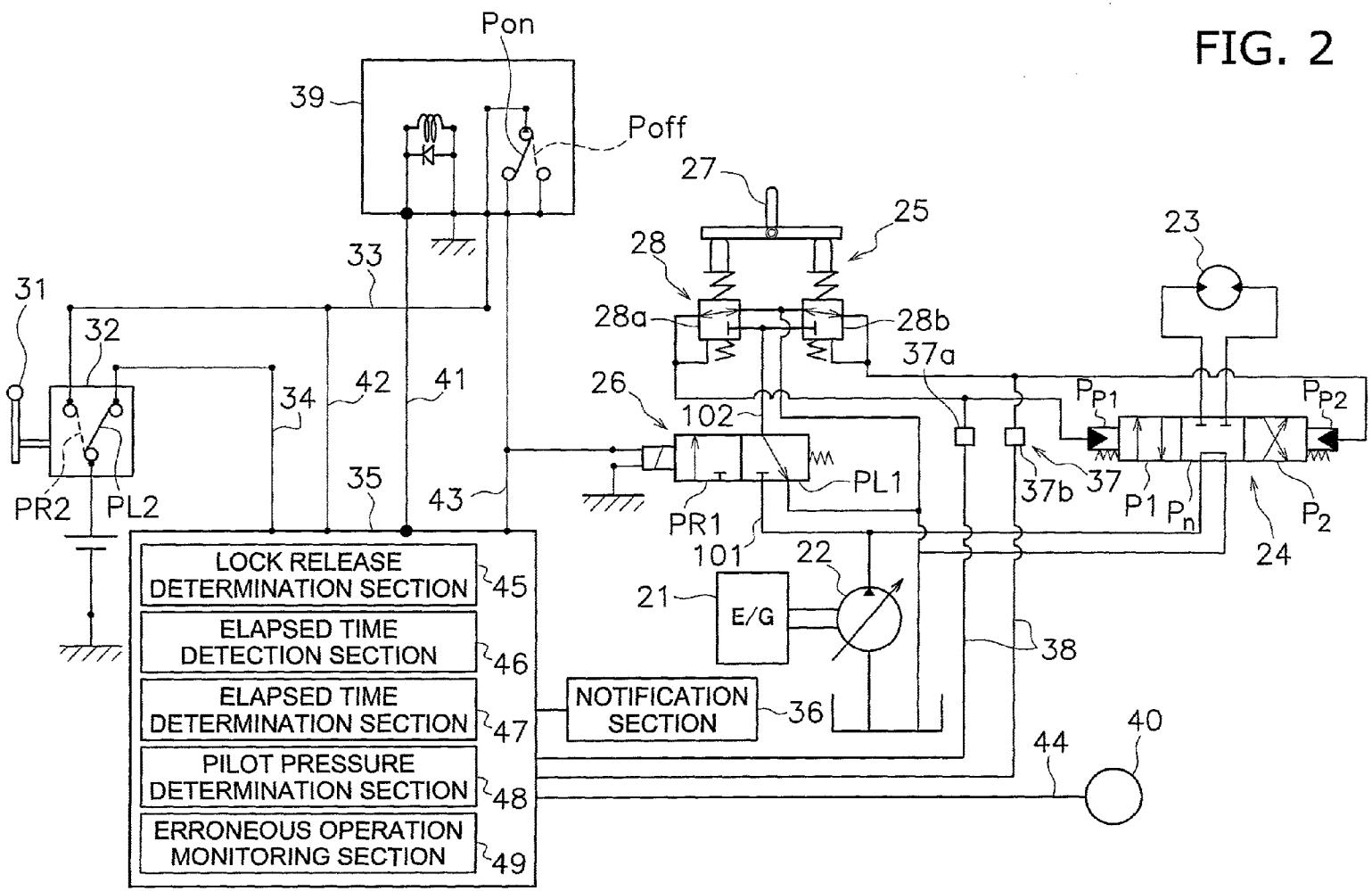
FIG. 2 is a schematic diagram illustrating a configuration of a driving system and an operation system of the work vehicle.

FIG. 2 is a schematic diagram illustrating a configuration of a driving system and an operation system which are mounted in the work vehicle 100. As shown in FIG. 2, the work vehicle 100 is provided with an engine 21, the hydraulic pump 22, and a hydraulic actuator 23. The hydraulic pump 22 discharges the hydraulic fluid by being driven by the engine 21. The hydraulic actuator 23 is driven using the hydraulic fluid which is discharged from the hydraulic pump 22. The hydraulic actuator 23 is a hydraulic motor which, for example, carries out revolution of the revolving body 3.

The work vehicle 100 is provided with an actuator control valve 24, the operation device 25, and a lock valve 26. The actuator control valve 24 controls the hydraulic actuator 23 according to the pilot pressure which is input. Specifically, the actuator control valve 24 is a direction switching valve which switches the supply direction of the hydraulic fluid of the hydraulic actuator 23. The actuator control valve 24 is switched between a first position state P1, a second position state P2, and a neutral position state Pn. In the first position state P1, the actuator control valve 24 supplies hydraulic fluid to the hydraulic actuator 23 so as to drive the hydraulic actuator 23 in a first direction. In the second position state P2, the actuator control valve 24 supplies the hydraulic fluid to the hydraulic actuator 23 so as to drive the hydraulic actuator 23 in a second direction. The second direction is a direction which is opposite to the first direction. In the neutral position state Pn, the actuator control valve 24 blocks the supply of the hydraulic fluid to the hydraulic actuator 23. Due to this, the hydraulic actuator 23 stops. The actuator control valve 24 has a first pilot port Pp1 and a second pilot port Pp2. The actuator control valve 24 is set to the first position state P1 due to the pilot pressure being applied to the first pilot port Pp1. The actuator control valve 24 is set to the second position state P2 due to the pilot pressure being applied to the second pilot port Pp2. The actuator control valve 24 is set to the neutral position state Pn when the pilot pressure is not applied to either of the first pilot port Pp1 or the second pilot port Pp2.

The operation device 25 is a device for operating the hydraulic actuator 23. The operation device 25 has an operation member 27 and a pilot valve 28. The operation member 27 is, for example, an operation lever. The pilot valve 28 is supplied the hydraulic fluid from the hydraulic pump 22. The pilot valve 28 outputs the pilot pressure according to the operation of the operation member 27. That is, the pilot valve 28 reduces the pressure of the hydraulic fluid from the hydraulic pump to the pilot pressure according to the operation of the operation member 27. The pilot valve 28 has a first pilot valve 28*a* and a second pilot valve 28*b*. The pilot pressure which is output from the first pilot valve 28*a* (referred to below as "first pilot pressure") is applied to the first pilot port Pp1 of the actuator control valve 24. The pilot pressure which is output from the second pilot valve 28*b* (referred to below as "second pilot pressure") is applied to the second pilot port Pp2 of the actuator control valve 24. Due to this, the actuator control valve 24 is set to any one of the first position state P1, the second position state P2, or the neutral position state Pn according to the operation of the operation member 27.

The lock valve 26 is disposed in the fluid passage which connects the hydraulic pump 22 and the pilot valve 28. The lock valve 26 is an electromagnetic valve. The lock valve 26 is switched between a released state PR1 and a locked state PL1 according to the presence or absence of an input of a release signal. Specifically, the lock valve 26 is maintained in the locked state PL1 when there is no input of the release signal. The lock valve 26 is switched from the locked state PL1 to the released state PR1 when a release signal is input. The lock valve 26 connects a fluid passage 101 on the hydraulic pump 22 side and a fluid passage 102 on the pilot valve 28 side in the released state PR1. Due to this, the hydraulic fluid is supplied from the hydraulic pump 22 to the pilot valve 28. That is, the lock valve 26 permits the supply of the pilot pressure to the actuator control valve 24 in the released state PR1. Due to this, the activation of the hydraulic actuator is permitted. The lock valve 26 blocks the fluid passage 101 on the hydraulic pump 22 side and the fluid passage 102 on the pilot valve 28 side in the locked state PL1. The lock valve 26 connects the fluid passage 102 on the pilot valve 28 side to a hydraulic fluid tank in the locked state PL1. Due to this, the hydraulic fluid from the hydraulic pump 22 is not supplied to the pilot valve 28. That is, the lock valve 26 blocks the supply of the pilot pressure to the actuator control valve 24 in the locked state PL1. The actuator control valve 24 is maintained in the neutral position state Pn regardless of the operation of the operation member 27 with the lock valve 26 in the locked state PL1. Accordingly, the hydraulic actuator 23 is not activated even if the operator operates the operation member 27 with the lock valve 26 in the locked state PL1. That is, activation of the hydraulic actuator is prohibited.

As shown in FIG. 2, the work vehicle 100 is provided with a lock member 31, a lock switch 32, a first signal line 33, a second signal line 34, a controller 35, and a notification section 36.

The lock member 31 is disposed in the cab 4. The lock member 31 is able to be switched between the locked position and the release position. For example, the lock member 31 is disposed so as to protrude into the cab 4 in the release position. The lock member 31 is disposed so as not to protrude into the cab 4 or so that the protrusion amount into the cab 4 is small in the locked position. The lock switch 32 is switched between a locked position PL2 and a release position PR2 in conjunction with the activation of the lock member 31. The lock switch 32 is positioned in the locked position PL2 when the lock member 31 is positioned in the locked position. The lock switch 32 is positioned in the release position PR2 when the lock member 31 is positioned in the release position.

The first signal line 33 transmits the release signal from the lock switch 32 to the lock valve 26. The release signal from the lock switch 32 is input into the lock valve 26 via the first signal line 33 when the lock switch 32 is set in the release position PR2. Due to this, the lock valve 26 is set in the released state PR1. The second signal line 34 transmits a lock switch signal from the lock switch 32 to the controller 35. The lock switch signal from the switch 32 is input into the controller 35 via the second signal line 34 when the lock switch 32 is set in the locked position PL2. At this time, the lock valve 26 is set in the locked state PL1 so that the release signal from the lock switch 32 is not input into the lock valve 26.

The controller 35 includes a memory such as a RAM or a ROM and a computation device such as a CPU. The notification section 36 is, for example, a monitor. The controller 35 outputs a notification with regard to the operator from the notification section 36 when the controller 35 receives the lock switch signal via the second signal line 34. The notification with regard to the operator is performed by, for example, displaying a message or an icon on the monitor.

In addition, the work vehicle 100 is provided with a pilot pressure detection section 37 and a third signal line 38. The pilot pressure detection section 37 detects the pilot pressure. The pilot pressure detection section 37 has a plurality of pressure sensors. Specifically, the pilot pressure detection section 37 has a first pressure sensor 37*a* and a second pressure sensor 37*b*. The first pressure sensor 37*a* detects the first pilot pressure. The second pressure sensor 37*b* detects the second pilot pressure. The third signal line 38 transmits a signal from the pilot pressure detection section 37 to the controller 35. As will be described later, the controller 35 performs determination of an erroneous operation at the time of operation of the lock member 31 based on the pilot pressure which is detected by the pilot pressure detection section 37.

In addition, the work vehicle 100 is provided with a relay 39, a fourth signal line 41, a fifth signal line 42, and a sixth signal line 43. The relay 39 is disposed in the first signal line 33. The fourth signal line 41 transmits the signal from the controller 35 to the relay 39. The relay 39 is switched between an on state Pon and an off state Poff according to the presence or absence of the signal from the controller 35. The relay 39 connects the lock switch 32 and the lock valve 26 in the on state Pon. Due to this, it is possible for the release signal from the lock switch 32 to be transmitted to the lock valve 26. The relay 39 blocks between the lock switch 32 and the lock valve 26 in the off state Poff. Due to this, it is not possible for the release signal from the lock switch 32 to be transmitted to the lock valve 26. The relay 39 is set to the on state Pon when the signal from the controller 35 is input. The relay 39 is set to the off state Poff when the signal from the controller 35 is not input.

The fifth signal line 42 connects between the lock switch 32 and the relay 39 in the first signal line 33. Accordingly, the release signal from the lock switch 32 is transmitted to the controller 35 via the fifth signal line 42. The controller 35 detects whether or not the lock member 31 is set in the release position based on the presence or absence of the release signal which the controller 35 receives via the fifth signal line 42. The sixth signal line 43 connects between the relay 39 and the lock valve 26 in the first signal line 33. Accordingly, the controller 35 detects whether the relay 39 is in a state of either the on state Pon or the off state Poff and whether the lock valve 26 is in a state of either the locked state PL1 or the released state PR1 based on the presence or absence of the release signal which the controller 35 receives via the sixth signal line 43.

In addition, the work vehicle 100 is provided with a key switch 40 and a seventh signal line 44. The key switch 40 switches between the on state and the off state using a key for starting up the work vehicle 100. The key switch 40 outputs a signal in the on state. The seventh signal line 44 transmits the signal from the key switch 40 to the controller 35.

Figure 3:
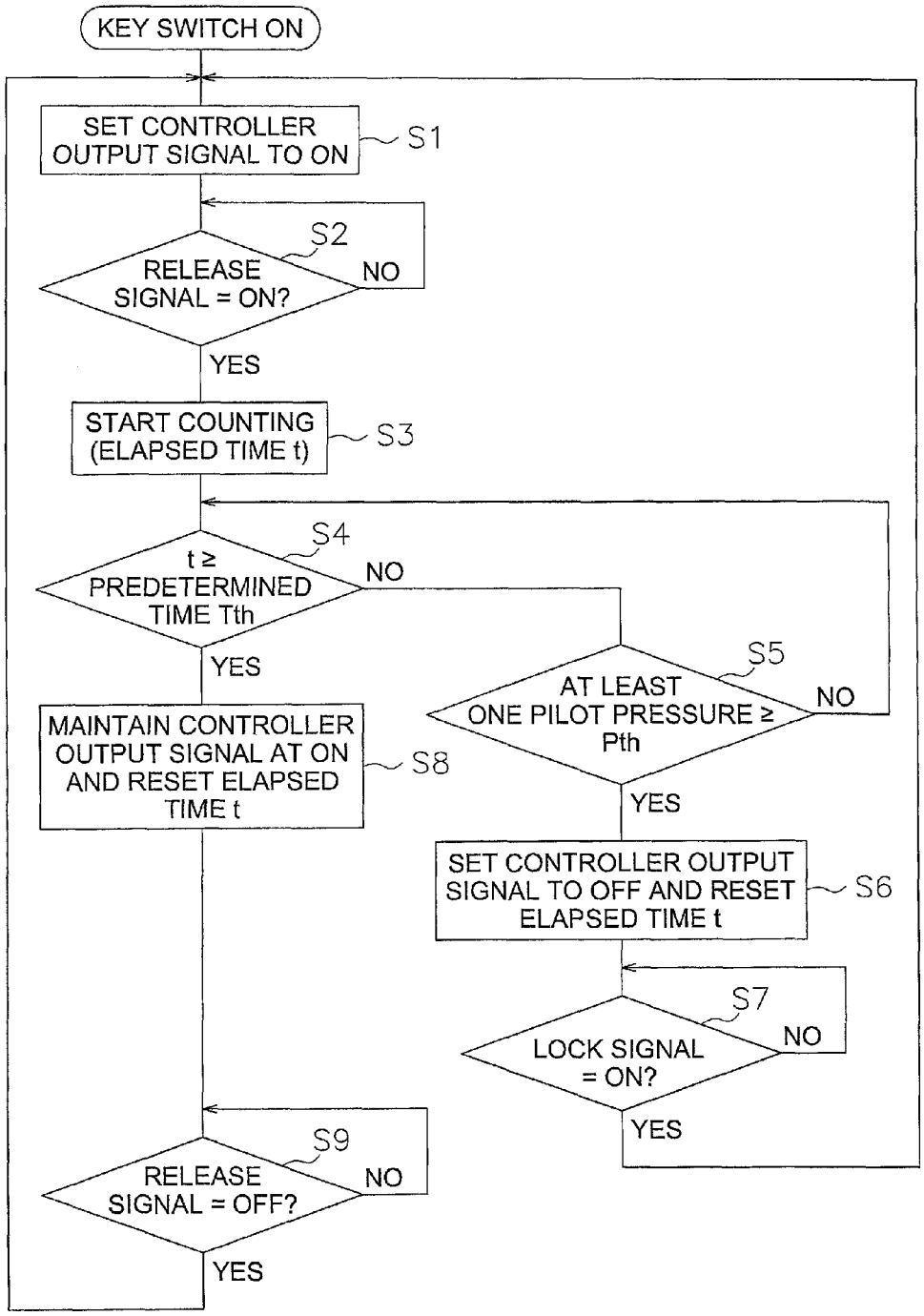
FIG. 3 is a flow chart illustrating an erroneous operation determination process.
Figure 4:
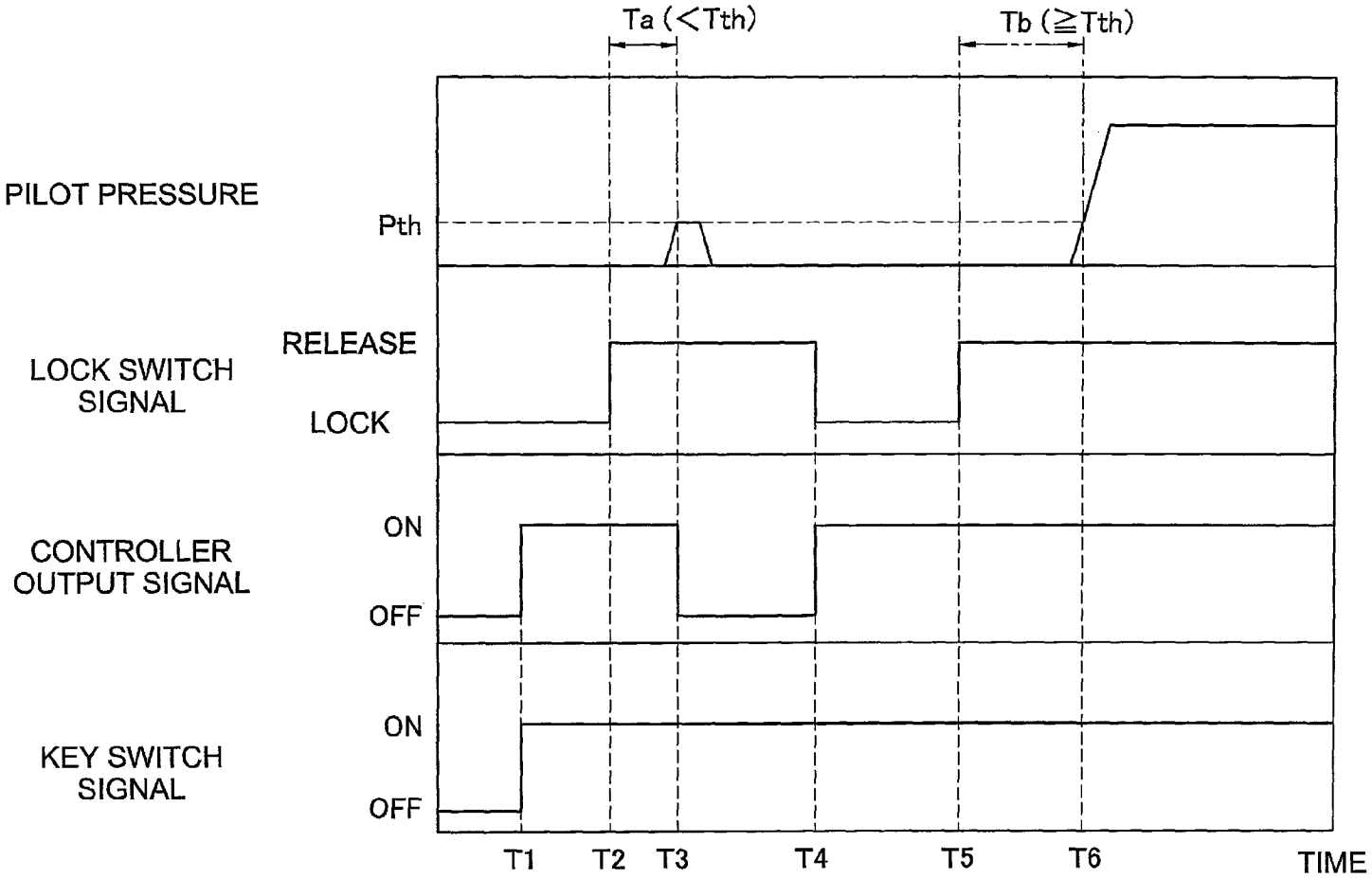
FIG. 4 is a timing chart illustrating changes in each type of signal during determination of an erroneous operation.

Next, an erroneous operation determination process which is executed by the controller 35 will be described. As shown in FIG. 2, the controller 35 includes a lock release determination section 45, an elapsed time detection section 46, an elapsed time determination section 47, a pilot pressure determination section 48, and an erroneous operation monitoring section 49. FIG. 3 is a flow chart illustrating an erroneous operation determination process. FIG. 4 is a timing chart illustrating changes in the pilot pressure, a lock switch signal, a controller output signal, and a key switch signal during erroneous operation determination. The lock switch signal is a signal from the lock switch 32 which is detected by the controller 35. Specifically, the lock switch signal is either of a lock switch signal which is transmitted via the second signal line 34 or a release signal which is transmitted via the fifth signal line 42. The controller output signal is a signal which is output from the controller 35 to the relay 39. The controller output signal being on has the meaning of outputting the signal from the controller 35 to the relay 39. The controller output signal being off has the meaning of not outputting the signal from the controller 35 to the relay 39. The key switch signal is a signal which is output from the key switch 40 to the controller 35. The key switch signal being on has the meaning of outputting the signal from the key switch 40 to the controller 35. The key switch signal being off has the meaning of not outputting the signal from the key switch 40 to the controller 35. Here, the pilot pressure as shown in FIG. 4 is exemplified by one of a plurality of pilot pressures which are detected by the pilot pressure detection section 37.

As shown in FIG. 3, in step S1, the erroneous operation monitoring section 49 sets the controller output signal to on when the key switch 40 is in the on state (time T1 in FIG. 4). Due to this, the relay 39 is set to the on state Pon. In this case, it is possible to switch the state of the lock valve 26 according to the position of the lock switch 32. That is, it is possible to switch between lock and release of the hydraulic actuator 23 according to the operation of the lock member 31.

In step S2, the lock release determination section 45 determines whether or not the release signal is on. The lock release determination section 45 determines that the release signal is on when the release signal is transmitted to the controller 35 via the fifth signal line 42. That is, the lock release determination section 45 determines whether or not the lock member 31 is switched to the release position. When the release signal is on (time T2 in FIG. 4), the process proceeds to step S3. The release signal is transmitted to the lock valve 26 via the first signal line 33 when the release signal is on and the relay 39 is in the on state Pon. Accordingly, the lock valve 26 is set in the release state PR1. Due to this, the pilot pressure starts to increase according to the operation of the operation member 27.

In step S3, the elapsed time detection section 46 starts counting elapsed time. The elapsed time is an elapsed time (elapsed time Ta in FIG. 4) from a point in time when the lock is released, that is, from a point in time (time T2 in FIG. 4) when the lock member 31 is switched from the locked position to the release position.

In step S4, the elapsed time determination section 47 determines whether or not the elapsed time is equal to or more than a predetermined time Tth. The predetermined time Tth is a time until the pilot pressure rises to a predetermined pressure Pth when the lock member 31 is switched from the locked position to the release position in a state where the operation member 27 is in a position for activating the hydraulic actuator 23. The predetermined time Tth is found using either experiments in advance or simulation and is stored in the controller 35. It is preferable if the predetermined time is equal to or more than 0.2 seconds and equal to or less than 2 seconds. When the elapsed time is not equal to or more than the predetermined time Tth, the process proceeds to step S5. That is, in FIG. 4, when the time Ta is smaller than the predetermined time Tth, the process proceeds to step S5.

In step S5, the pilot pressure determination section 48 determines whether or not at least one of the plurality of pilot pressures is equal to or more than the predetermined pressure Pth. When not even one pilot pressure is equal to or more than the predetermined pressure Pth, the process returns to step S4. When at least one pilot pressure is equal to or more than the predetermined pressure Pth (time T3 in FIG. 4), the process proceeds to step S6.

In step S6, the controller output signal is set to off (time T3 in FIG. 4). In addition, the elapsed time detection section 46 resets the elapsed time to 0. The relay 39 is set in the off state Poff when the controller output signal is set to off. That is, the erroneous operation monitoring section 49 switches the lock valve 26 to the locked state PL1 even if the lock switch 32 is in the release position PR2 when the elapsed time is less than the predetermined time Tth. As a result, the pilot pressure of the actuator control valve 24 does not increase regardless of the operation of the operation member 27 and reduces after the controller output signal is set to off. As a result, the operation of the hydraulic actuator 23 is locked even where the lock member 31 is in the release position.

In step S7, the lock release determination section 45 determines whether or not the lock switch signal is on. The lock switch signal being on has the meaning of transmitting the lock switch signal to the controller 35 via the second signal line 34. The controller output signal is maintained off when the lock switch signal is not on. That is, the erroneous operation monitoring section 49 maintains the lock valve 26 in the locked state PL1 as long as the lock member 31 is not returned from the release position to the locked position after at least one pilot pressure becomes equal to or more than the predetermined pressure Pth when the elapsed time is less than the predetermined time Tth. Due to this, the blocking of the pilot pressure to the actuator control valve 24 is maintained. When the lock switch signal is on (time T4 in FIG. 4), the process returns to step S1. That is, when the lock member 31 returns from the release position to the locked position, the process returns to step S1.

As described above, in step S1, the controller output signal is set to on (time T4 in FIG. 4). Due to this, it is possible to switch the hydraulic actuator 23 between being locked and released according to the operation of the lock member 31. In addition, in step S2, the lock release determination section 45 determines whether or not the release signal is on. When the release signal is on (time T5 in FIG. 4), the process proceeds to step S3. In step S3, the elapsed time detection section 46 starts counting elapsed time. The elapsed time is an elapsed time (elapsed time Tb in FIG. 4) from a point in time (time T5 in FIG. 4) where the lock member 31 is switched from the locked position to the release position.

In step S4, when the elapsed time is equal to or more than the predetermined time Tth, the process proceeds to step S8.

That is, when none of the pilot pressures is equal to or more than the predetermined pressure Pth until the elapsed time rises to the predetermined time Tth, the process proceeds to step S8.

In step S8, the erroneous operation monitoring section 49 maintains the controller output signal as on (time T6 and beyond in FIG. 4). That is, the erroneous operation monitoring section 49 maintains the relay 39 in the on state Pon. Due to this, the lock valve 26 is maintained in the released state PR1 while the lock member 31 is set in the release position. As a result, the pilot pressure increases according to the operation of the operation member 27. In addition, the elapsed time detection section 46 resets the elapsed time to 0.

In step S9, the lock release determination section 45 determines whether or not the release signal is off. The release signal being off has the meaning of not transmitting the release signal to the controller 35 via the fifth signal line 42. When the release signal is off, the process returns to step S1. That is, when the lock member 31 is switched from the release position to the locked position, the process returns to step S1.

In the vehicle body 100 according to the present embodiment of the present invention, the lock valve 26 is switched from the locked state PL1 to the released state PR1 using the release signal from the lock switch 32 when the lock member 31 is switched from the locked position to the release position. However, the erroneous operation monitoring section 49 returns the lock valve 26 to the locked state PL1 even if the lock member 31 is set in the released state in a case where the pilot pressure is equal to or more than the predetermined pressure Pth when the elapsed time is less than the predetermined time Tth. The pilot pressure rapidly rising in such a manner has the meaning of switching the lock member 31 to the release position in the state where the operation member 27 is set in the activation position. Due to this, it is possible to accurately determine whether or not the operation member 27 is set in the activation position when the lock member 31 is switched to the release position. In addition, the erroneous operation monitoring section 49 maintains the lock valve 26 in the released state PR1 in a case where the pilot pressure is equal to or more than the predetermined pressure Pth when the elapsed time is equal to or more than the predetermined time Tth. The pilot pressure slowly rising in such a manner has the meaning of switching the lock member 31 to the release position in the state where the operation member 27 is not set in the activation position. Due to this, it is possible to accurately determine that the operation member 27 is not set in the activation position when the lock member 31 is switched to the release position.

The lock valve 26 is disposed in the fluid passage which connects the hydraulic pump 22 and the pilot valve 28. As a result, it is possible to block the pilot pressure which is output to a plurality of fluid passages with one lock valve 26.

The erroneous operation monitoring section 49 blocks the supply of the pilot pressure to the actuator control valve 24 when the elapsed time which corresponds to at least one pilot pressure from among the plurality of pilot pressures is less than the predetermined time Tth. As a result, it is possible to more reliably suppress erroneous operations of the hydraulic actuator 23 when the lock member 31 is switched to the release position.

The erroneous operation monitoring section 49 maintains the blocking of the pilot pressure to the actuator control valve 24 as long as the lock member 31 is not returned from the release position to the locked position when at least one pilot pressure is equal to or more than the predetermined pressure Pth when the elapsed time is less than the predetermined time Tth. As a result, it is possible to reliably suppress erroneous operations of the hydraulic actuator 23.

Above, an embodiment of the present invention has been described but the present invention is not limited to the embodiment described above, and various modifications are possible in a scope which does not depart from the gist of the invention.

In the embodiment described above, a hydraulic shovel is given as an example of the work vehicle, but the present invention may be applied to other types of work vehicles such as a wheel loader or a bulldozer.

In the embodiment described above, a hydraulic motor for revolution of a revolving body is given as an example of the hydraulic actuator but other hydraulic actuators may be used. For example, the hydraulic motor for movement (not shown), the boom cylinder 10, the arm cylinder 11, or the bucket cylinder 12 may be used. Alternatively, a combination of some of these or a combination of all of these may be used. That is, the plurality of pilot pressures which are used in step S5 described above are not limited to the hydraulic motor for revolution, and may be pilot pressures to an actuator control valve for controlling a hydraulic motor for movement (not shown), the boom cylinder 10, the arm cylinder 11, or the bucket cylinder 12, or the like.

The notification section 36 may output a notification with regard to the operator when the erroneous operation monitoring section 49 blocks the supply of pilot pressure to the actuator control valve 24. Due to this, it is possible for the operator to recognize an error in the operating of the operation member 27 when the lock member 31 is switched to the release position using a notification from the notification section 36. In the embodiment described above, a monitor is given as an example of the notification section 36, but another device such as a lamp or a buzzer may be used.

The lock member 31 and the operation member 27 are not limited to a lever, and may be members with other arrangements such as a switch, a button, or a pedal.

Figure 5:
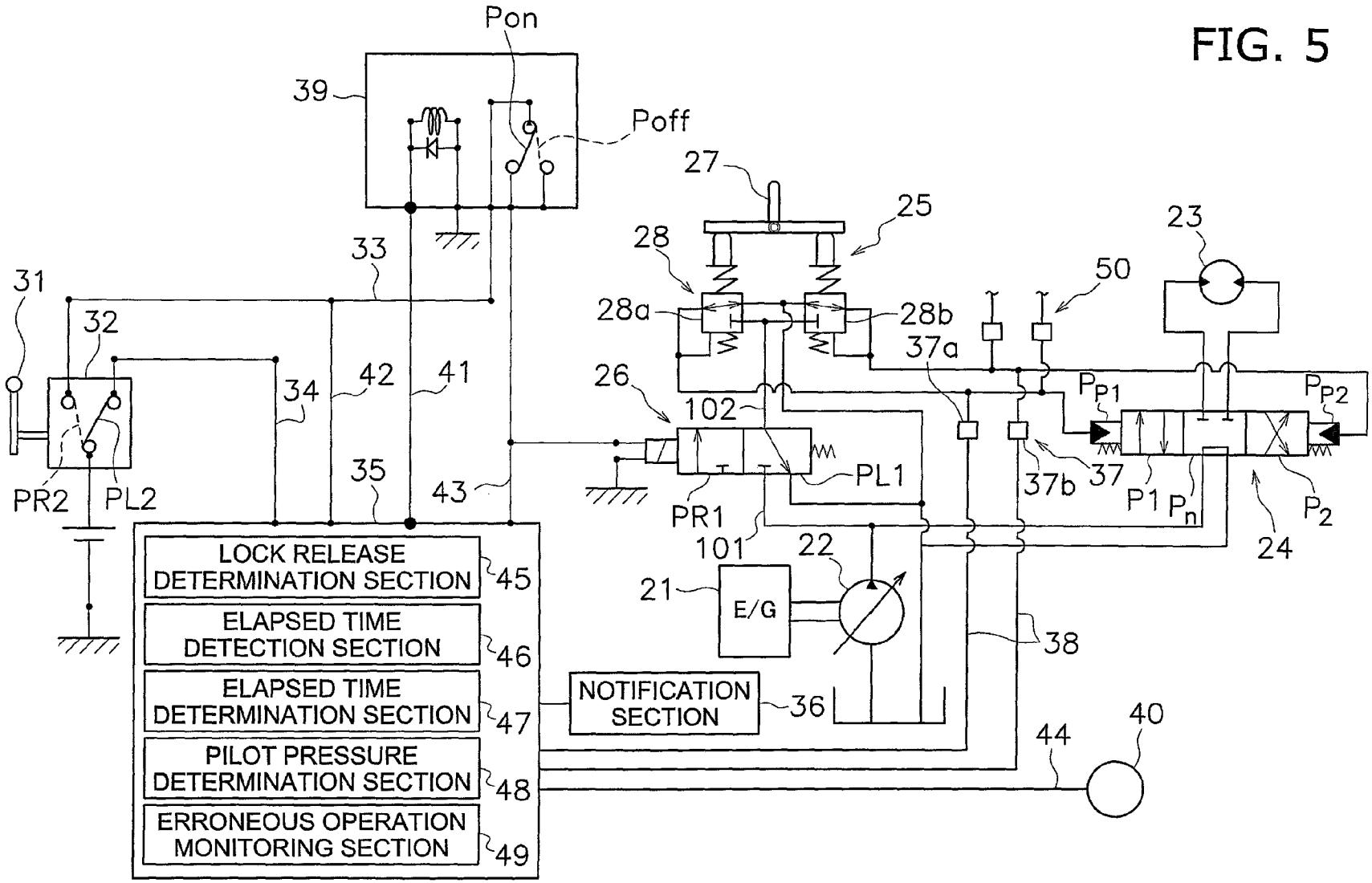
FIG. 5 is a schematic diagram illustrating a configuration of a driving system and an operation system according to another embodiment.

As shown in FIG. 5, the work vehicle 100 may be further provided with a temperature detection section 50 which detects the temperature of hydraulic fluid. In this case, the elapsed time determination section 47 increases the predetermined time Tth as the temperature of the hydraulic fluid falls. Due to this, it is possible to more accurately determine whether or not the operation member 27 is set in the activation position when the lock member 31 is switched to the release position.

INDUSTRIAL APPLICABILITY

According to the present invention, it is possible to provide a work vehicle and control method of a work vehicle where it is possible to accurately determine whether or not an operation member is operated in an activation position when a lock member is switched to a release position.

The invention claimed is:

1. A work vehicle comprising:

a hydraulic actuator;

an operation member configured to operate the hydraulic actuator;

a pilot valve configured to output a pilot pressure according to operation of the operation member;

an actuator control valve configured to control the hydraulic actuator according to the pilot pressure input thereto;

a lock member switchable between a locked position and a release position;

a lock valve switchable between a released state in which the lock valve permits supply of the pilot pressure to the actuator control valve and a locked state in which the lock valve blocks the supply of the pilot pressure to the actuator control valve;

a lock valve switching section configured to switch the lock valve from the locked state to the released state when the lock member is switched from the locked position to the release position;

an elapsed time detection section configured to detect elapsed time from a point in time when the lock member is switched from the locked position to the release position;

an elapsed time determination section configured to determine whether the elapsed time is equal to or more than a predetermined time;

a pilot pressure determination section configured to determine whether the pilot pressure is equal to or more than a predetermined pressure; and an erroneous operation monitoring section configured to permit switching of the lock valve by the lock valve switching section when the pilot pressure is equal to or more than the predetermined pressure when the elapsed time is equal to or more than the predetermined time, and to switch the lock valve to the locked state when the pilot pressure is equal to or more than the predetermined pressure when the elapsed time is less than the predetermined time.

2. The work vehicle according to claim 1, wherein the predetermined time is equal to or more than 0.2 seconds and equal to or less than 2 seconds.

3. The work vehicle according to any one of claim 2, wherein the work vehicle is a hydraulic shovel including a revolving body, and the hydraulic actuator is any one of a revolving motor configured to carry out revolution of the revolving body, a hydraulic motor, a boom cylinder, an arm cylinder, and a bucket cylinder.

4. The work vehicle according to claim 1, further comprising:

a hydraulic pump configured to supply hydraulic fluid to the pilot valve, the lock valve being disposed in a fluid passage connecting the hydraulic pump and the pilot valve.

5. The work vehicle according to any one of claim 4, wherein the work vehicle is a hydraulic shovel including a revolving body, and the hydraulic actuator is any one of a revolving motor configured to carry out revolution of the revolving body, a hydraulic motor, a boom cylinder, an arm cylinder, and a bucket cylinder.

6. The work vehicle according to claim 1, further comprising:

a controller including the elapsed time detection section, the elapsed time determination section, and the erroneous operation monitoring section;

a pilot pressure detection section configured to detect the pilot pressure;

a first signal line configured to transmit a signal from the lock valve switching section to the lock valve;

a second signal line configured to transmit a signal from the lock valve switching section to the controller;

a third signal line configured to transmit a signal from the pilot pressure detection section to the controller;

a relay disposed in the first signal line; and a fourth signal line configured to transmit a signal from the controller to the relay.

7. The work vehicle according to any one of claim 6, wherein the work vehicle is a hydraulic shovel including a revolving body, and the hydraulic actuator is any one of a revolving motor configured to carry out revolution of the revolving body, a hydraulic motor, a boom cylinder, an arm cylinder, and a bucket cylinder.

8. The work vehicle according to claim 1, wherein the pilot pressure is a first pilot pressure, the pilot valve is configured to output a plurality of pilot pressures including the first pilot pressure and a second pilot pressure, the second pilot pressure is output from a fluid passage different than the first pilot pressure, and the erroneous operation monitoring section is configured to switch the lock valve to the locked state when at least one of the pilot pressures from among the plurality of pilot pressures is equal to or more than the predetermined pressure when the elapsed time is less than the predetermined time.

9. The work vehicle according to any one of claim 8, wherein the work vehicle is a hydraulic shovel including a revolving body, and the hydraulic actuator is any one of a revolving motor configured to carry out revolution of the revolving body, a hydraulic motor, a boom cylinder, an arm cylinder, and a bucket cylinder.

10. The work vehicle according to claim 1, wherein the erroneous operation monitoring section is configured to prohibit switching of the lock valve by the lock valve switching section as long as the lock member is not returned to the locked position from the release position when the elapsed time determination section determines that the elapsed time is less than the predetermined time.

11. The work vehicle according to any one of claim 10, wherein the work vehicle is a hydraulic shovel including a revolving body, and the hydraulic actuator is any one of a revolving motor configured to carry out revolution of the revolving body, a hydraulic motor, a boom cylinder, an arm cylinder, and a bucket cylinder.

12. The work vehicle according to claim 1, further comprising:

a notification section configured to output notification to an operator when the erroneous operation monitoring section switches the lock valve into the locked state.

13. The work vehicle according to any one of claim 12, wherein the work vehicle is a hydraulic shovel including a revolving body, and the hydraulic actuator is any one of a revolving motor configured to carry out revolution of the revolving body, a hydraulic motor, a boom cylinder, an arm cylinder, and a bucket cylinder.

14. The work vehicle according to claim 1, further comprising:

a temperature detection section configured to detect a temperature of the hydraulic fluid, the elapsed time determination section being further configured to increase the predetermined time as the temperature of the hydraulic fluid falls.

15. The work vehicle according to any one of claim 14, wherein the work vehicle is a hydraulic shovel including a revolving body, and the hydraulic actuator is any one of a revolving motor configured to carry out revolution of the revolving body, a hydraulic motor, a boom cylinder, an arm cylinder, and a bucket cylinder.

16. The work vehicle according to claim 1, wherein the work vehicle is a hydraulic shovel including a revolving body, and the hydraulic actuator is any one of a revolving motor configured to carry out revolution of the revolving body, a hydraulic motor, a boom cylinder, an arm cylinder, and a bucket cylinder.

17. A control method of a work vehicle, the work vehicle including a hydraulic actuator, an operation member configured to operate the hydraulic actuator, a pilot valve configured to output a pilot pressure according to operation of the operation member, an actuator control valve configured to control the hydraulic actuator according to the pilot pressure output from the pilot valve, a lock member switchable between a locked position and a release position, and a lock valve switchable between a released state in which the lock valve permits supply of the pilot pressure to the actuator control valve and a locked state in which the lock valve blocks the supply of pilot pressure to the actuator control valve, the method comprising:

switching the lock valve from the locked state to the released state when the lock member is switched from the locked position to the release position;

detecting elapsed time from a point in time when the lock member is switched from the locked position to the release position until the pilot pressure rises to the predetermined pressure;

determining whether the elapsed time is equal to or more than a predetermined time;

maintaining the lock valve in the released state when the elapsed time is equal to or more than the predetermined time; and switching the lock valve to the locked state when the elapsed time is less than the predetermined time.

18. A control method of a work vehicle comprising:

switching a lock valve from a locked state in which the lock valve prohibits activating of a hydraulic actuator, to a released state in which the lock valve permits activating of the hydraulic actuator, when a lock member is switched from a locked position to a release position, and switching the lock valve to the locked state when the pilot pressure according to an operation of an operation member configured to operate the hydraulic actuator rises to a predetermined pressure within a predetermined time from a point in time when the lock member is switched from the locked position to the release position.

* * * * *